US012092113B2

(12) United States Patent
Matsuzaka et al.

(10) Patent No.: US 12,092,113 B2
(45) Date of Patent: Sep. 17, 2024

(54) HEAT RECOVERY DEVICE

(71) Applicant: Hitachi Industrial Equipment Systems Co., Ltd., Tokyo (JP)

(72) Inventors: Takehiro Matsuzaka, Tokyo (JP); Masakatsu Okaya, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 335 days.

(21) Appl. No.: 17/639,005

(22) PCT Filed: Jul. 20, 2020

(86) PCT No.: PCT/JP2020/028173
§ 371 (c)(1),
(2) Date: Feb. 28, 2022

(87) PCT Pub. No.: WO2021/053965
PCT Pub. Date: Mar. 25, 2021

(65) Prior Publication Data

US 2022/0341426 A1 Oct. 27, 2022

(30) Foreign Application Priority Data

Sep. 18, 2019 (JP) ..... 2019-169215

(51) Int. Cl.

| | |
|---|---|
| ***F04C 29/04*** | (2006.01) |
| ***F04B 39/06*** | (2006.01) |
| ***F04B 53/08*** | (2006.01) |
| ***F24D 17/00*** | (2022.01) |

(52) U.S. Cl.
CPC ..... *F04C 29/04* (2013.01); *F04B 39/06* (2013.01); *F04B 53/08* (2013.01); *F24D 17/0005* (2013.01); *F24D 2200/16* (2013.01); *F24D 2220/0271* (2013.01)

(58) Field of Classification Search
CPC .. F04C 29/04; F24D 17/0005; F24D 2200/16; F04B 39/06; F04B 53/08
See application file for complete search history.

(56) References Cited

U.S. PATENT DOCUMENTS 3,856,493 A * 12/1974 Bulkley ..... F04C 29/04 417/247
9,702,358 B2 * 7/2017 Vezil ..... B01D 5/0087
9,746,191 B2 * 8/2017 Kang ..... F01K 13/02
(Continued)

FOREIGN PATENT DOCUMENTS

JP 2005-30715 A 2/2005
JP 2012-137247 A 7/2012
(Continued)

OTHER PUBLICATIONS

International Search Report of PCT/JP2020/028173 dated Aug. 18, 2020.
(Continued)

*Primary Examiner* — Christopher S Bobish
(74) *Attorney, Agent, or Firm* — MATTINGLY & MALUR, PC

(57) ABSTRACT

A preheating heat exchanger allows heat exchange between cooling water on an outlet side of an auxiliary cooling heat exchanger and supply water that has passed through a preheating bypass path.

16 Claims, 4 Drawing Sheets

(56) References Cited

U.S. PATENT DOCUMENTS

| | | | | |
|---|---|---|---|---|
| 9,869,466 | B2 * | 1/2018 | Thomson | F22B 1/16 |
| 9,976,569 | B2 * | 5/2018 | Janssens | F04D 29/5833 |
| 10,578,339 | B2 * | 3/2020 | Yamamoto | F04B 41/00 |
| 2007/0261823 | A1 | 11/2007 | Masters et al. | |
| 2012/0090340 | A1 * | 4/2012 | Okamoto | F04C 29/04 62/238.2 |
| 2013/0247845 | A1 | 9/2013 | Nakashoji et al. | |
| 2018/0202445 | A1 * | 7/2018 | Dreifert | F04D 29/584 |
| 2022/0106954 | A1 * | 4/2022 | Klaus | F04B 53/08 |
| 2022/0170666 | A1 * | 6/2022 | Yamamoto | F04B 41/00 |
| 2023/0249125 | A1 * | 8/2023 | Schneider | B01D 53/265 418/83 |

FOREIGN PATENT DOCUMENTS

| | | | |
|---|---|---|---|
| JP | 2016-079894 | A | 5/2016 |
| JP | 2018-165585 | A | 10/2018 |

OTHER PUBLICATIONS

Written Opinion of the International Search Authority of PCT/JP2020/028173 dated Aug. 18, 2020.

* cited by examiner

HEAT RECOVERY DEVICE

TECHNICAL FIELD

The present invention relates to a heat recovery device.

BACKGROUND ART

In the related art, a heat recovery system has been known in which in a compressor that compresses gas such as air, heat exchange is performed between a high-temperature fluid after compression and cooling water of a lower temperature therethan, to recover heat from the high-temperature fluid and to effectively use the heated cooling water. For example, Patent Document 1 discloses this type of technique in the related art.

In Patent Document 1, a heat recovery heat exchanger is provided in an air path from a compressor to an air cooler, and allows heat exchange between compressed air and water to produce hot water. An air path from the compressor to the heat recovery heat exchanger and an air path from the heat recovery heat exchanger to the air cooler are connected to each other by a bypass path.

The compressed air from the compressor can be switched between flowing to the heat recovery heat exchanger and flowing to the bypass path. When the compressed air passes through the bypass path, the compressed air passes through the air cooler and during that time, is cooled by cooling water introduced from a cooling water path. The cooling water that is increased in temperature by heat taken from the compressed air is cooled by a cooling tower, and circulates through the cooling water path again.

When the compressed air passes through the air path, the compressed air passes through the heat recovery heat exchanger and during that time, heat of the compressed air heats water introduced from a water supply path, to produce hot water.

CITATION LIST

Patent Document

Patent Document 1: JP 2016-79894 A

SUMMARY OF THE INVENTION

Problems to be Solved by the Invention

In Patent Document 1, the cooling water path and the water supply path are separated from each other, and heat exchange between these water paths is not intended. It is only described that the cooling water after passing through the air cooler is increased in temperature and is cooled by the cooling tower to flow to the air cooler through the cooling water path again, but no attempt has been made to recover heat from hot water after passing through the air cooler.

On the other hand, the water from a water supply source passes through the heat recovery heat exchanger via the water supply path to become hot water during that time, but it is assumed that the temperature of the water before passing through the heat recovery heat exchanger is lower than the temperature of the cooling water after passing through the air cooler.

When the temperature of the water before passing through the heat recovery heat exchanger is lower than the temperature of the cooling water after passing through the air cooler, a low-temperature side can be preheated by transferring heat from a high-temperature side to the low-temperature side via any form of heat exchanger, but no such reference is made in Patent Document 1.

As described above, in Patent Document 1, it is not considered that liquid such as water can be preheated and then reheated by the heat recovery heat exchanger to supply the liquid of a higher temperature.

An object of the present invention is to allow the supply of supply water of a higher temperature by preheating the supply water and then by reheating the supply water with a heat recovery heat exchanger.

Solutions to Problems

According to one aspect of the present invention, there is provided a heat recovery device connected to at least one compressor, the device including: an auxiliary cooling heat exchanger that performs auxiliary cooling; a heat recovery exchanger that heats supply water; a preheating heat exchanger that preheats and supplies the supply water to the heat recovery exchanger; a supply water path that supplies the supply water to the heat recovery exchanger; and a preheating bypass path which branches from the supply water path to supply the supply water to the preheating heat exchanger, and through which the supply water preheated by the preheating heat exchanger returns to the supply water path. The preheating heat exchanger allows heat exchange between cooling water on an outlet side of the auxiliary cooling heat exchanger and the supply water that has passed through the preheating bypass path.

According to one aspect of the present invention, there is provided a heat recovery device connected to at least one compressor, the device including: an auxiliary cooling heat exchanger that performs auxiliary cooling; a heat recovery exchanger that heats supply water; a preheating heat exchanger that preheats and supplies the supply water to the heat recovery exchanger; a supply water path that supplies the supply water to the heat recovery exchanger; and a preheating bypass path which branches from the supply water path to supply the supply water to the preheating heat exchanger, and through which the supply water preheated by the preheating heat exchanger returns to the supply water path. The preheating heat exchanger allows heat exchange between cooling water supplied from an outside through a cooling water path and the supply water that has passed through the preheating bypass path.

Effects of the Invention

According to one aspect of the present invention, the supply water can be preheated and then reheated by the heat recovery heat exchanger to supply the supply water of a higher temperature.

MODE FOR CARRYING OUT THE INVENTION

Figure 1:
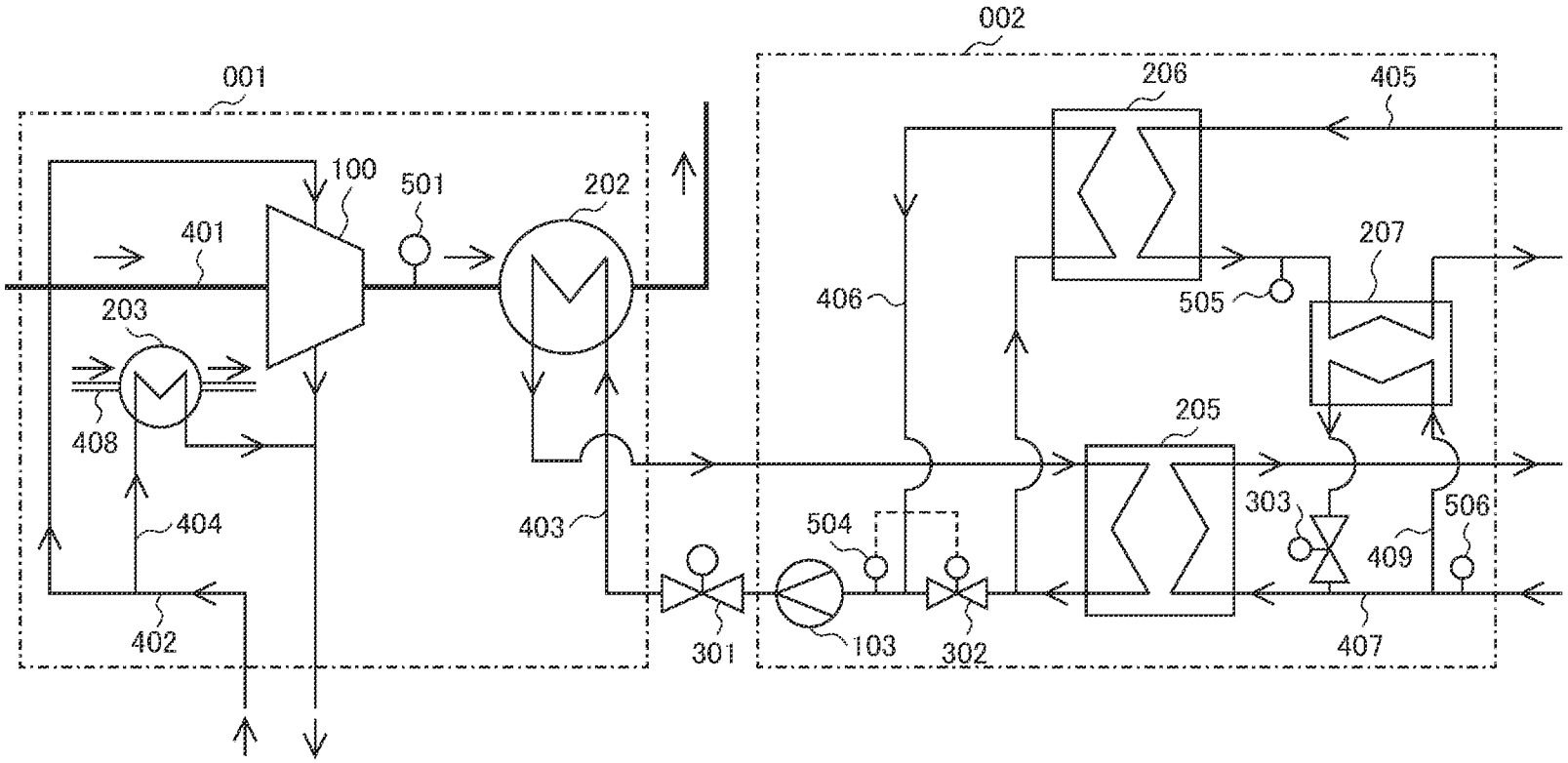
FIG. 1 is a system diagram illustrating a heat recovery system of a first embodiment.

Hereinbelow, embodiments will be described with reference to the drawings. Incidentally, in the drawings, portions denoted by the same reference signs indicate the same or equivalent portions.

First Embodiment

A configuration of a heat recovery system of a first embodiment will be described with reference to FIG. 1.

FIG. 1 illustrates a system diagram of a heat recovery system. In addition, effects obtained by the first embodiment will be described with reference to FIG. 2.

In addition, the first embodiment illustrates an example where the present invention is applied to a water-cooled oil-free screw compressor as a compressor unit.

An oil-free screw compressor illustrated in FIG. 1 is configured to suction and compress gas (air in the present embodiment) and to discharge the compressed gas.

In FIG. 1, a compressor unit 001 includes a single-stage compressor 100 that suctions air through an air path 401, compresses the air to a predetermined pressure, and discharges the compressed air, and a water-cooled aftercooler 202 that cools the discharged high-temperature compressed air. A discharge air temperature sensor 501 that measures a temperature of the discharged high-temperature compressed air is installed on the air path 401 downstream from the compressor 100.

In addition, a water-cooled oil cooler 203 is provided that cools a lubricant for lubrication of the compressor 100 and a drive mechanism (not illustrated), and the lubricant is supplied and circulated to each part through a lubricant path 408 according to internal needs of the compressor unit 001. The compressor 100 and the oil cooler 203 are normally cooled by cooling water passing through a first cooling water path 402 and an oil cooler cooling path 404 branching from the first cooling water path 402, and the cooling water in the first cooling water path 402 is circulated by a pump (not illustrated) that is separately installed, and heat of the cooling water is discharged to the outside by a cooling tower or the like (not illustrated).

Generally, the pump and the cooling tower are shared with an existing facility that are separate from the compressor unit 001 and a heat recovery unit 002 to be described later, and unless otherwise required as required specifications by a user, the compressor unit 001 or the heat recovery unit 002 does not directly control operation of the pump or the cooling tower. Here, the heat recovery unit 002 forms a heat recovery device.

In the heat recovery system, the heat recovery unit 002 is installed side by side with the compressor unit 001. The heat recovery unit 002 includes a heat recovery heat exchanger 205, an auxiliary cooling heat exchanger 206, a preheating heat exchanger 207, a circulation pump 103, a temperature regulation valve 302, a control valve 303, a heat recovery cooling water temperature sensor 504, a cooling water outlet temperature sensor 505, and a supply water temperature sensor 506.

A suction side of the circulation pump 103 is connected to an outlet side on a high-temperature fluid side of the heat recovery heat exchanger 205. In addition, a discharge side of the circulation pump 103 is connected to a cooling water inlet side of the aftercooler 202 in the compressor unit 001, and a cooling water outlet side of the aftercooler 202 is connected to an inlet side on the high temperature fluid side of the heat recovery heat exchanger 205, so that a second cooling water path 403 is formed. A water supply valve 306 is disposed on the second cooling water path 403 on the discharge side of the circulation pump 103. The water supply valve 306 operates in connection with the start of operation of the compressor unit 001, and is normally open during operation of the compressor unit 001.

A supply water path 407 is a path through which liquid such as relatively low-temperature water is supplied from the outside, and through which the liquid exchanges heat with high-temperature cooling water that is increased in temperature after cooling the high-temperature compressed air in the aftercooler 202 and that passes through the high-temperature fluid side of the heat recovery heat exchanger 205 on the second cooling water path 403, to be heated and returns to an outside hot water demand destination.

The liquid that circulates through the supply water path 407 is not particularly limited in its use, and examples of the liquid include water and the like that can be widely used for, for example, boiler supply water preheating, hot water heating, showering, and the like.

The temperature regulation valve 302 is provided at an outlet on the high-temperature fluid side of the heat recovery heat exchanger 205. The heat recovery cooling water temperature sensor 504 is provided on a downstream side of the temperature regulation valve 302, and the temperature regulation valve 302 operates to decrease a valve opening degree as the temperature measured by the heat recovery cooling water temperature sensor 504 increases, and to be fully closed at a predetermined heat recovery cooling water control temperature $T_{HC}$.

An auxiliary cooling bypass path 406 branches from a location between the outlet of the heat recovery heat exchanger 205 and the temperature regulation valve 302 on the second cooling water path 403, to merge with a location between the downstream side of the temperature regulation valve 302 on the second cooling water path 403 and the heat recovery cooling water temperature sensor 504 via a path on a high-temperature fluid side of the auxiliary cooling heat exchanger 206.

The temperature regulation valve 302 automatically regulates the opening degree according to a heat recovery cooling water temperature $T_{H2}$ measured by the heat recovery cooling water temperature sensor 504, to allow a part of or a total amount of the cooling water (heat recovery cooling water) in the second cooling water path 403 to flow to the auxiliary cooling bypass path 406.

Low-temperature cooling water cooled by the cooling tower is supplied to a path on a low-temperature fluid side of the auxiliary cooling heat exchanger 206 through a third cooling water path 405, and heat is exchanged between the high-temperature cooling water that has passed through the auxiliary cooling bypass path 406 and the low-temperature cooling water that has passed through the third cooling water path 405. Therefore, when the heat recovery cooling water temperature $T_{H2}$ measured by the heat recovery cooling water temperature sensor 504 reaches the predetermined heat recovery cooling water control temperature $T_{HC}$, the temperature regulation valve 302 is fully closed, and a total amount of the cooling water on the second cooling water path 403 is additionally cooled by the auxiliary cooling heat exchanger 206 after passing through the heat recovery heat exchanger 205, to return to the second cooling water path 403. Accordingly, the cooling water that is sufficiently cooled is supplied to the aftercooler 202, so that the compressed air temperature at an outlet of the aftercooler 202 is always suppressed to a certain temperature or less, which is an object.

An inlet of a path on a high-temperature fluid side of the preheating heat exchanger 207 is connected to a downstream side of an outlet of the path on the low-temperature fluid side of the auxiliary cooling heat exchanger 206 on the third cooling water path 405, and the cooling water outlet temperature sensor 505 is installed between the auxiliary cooling heat exchanger 206 and the preheating heat exchanger 207.

On the other hand, on the supply water path 407, a preheating bypass path 409 branches at a location upstream from an inlet on a low-temperature fluid side of the heat recovery heat exchanger 205, to merge again with a location downstream from the branch point and upstream from the inlet on the low-temperature fluid side of the heat recovery heat exchanger 205 via a path on a low-temperature fluid side of the preheating heat exchanger 207. In addition, the control valve 303 is provided on an outlet side of the preheating heat exchanger 207 on the preheating bypass path 409. The supply water temperature sensor 506 is provided on an upstream side of a branch point where the preheating bypass path 409 branches from the supply water path 407.

When a cooling water outlet temperature $T_{C2}$ measured by the cooling water outlet temperature sensor 505 is higher than a supply water supply temperature $T_{U1}$ measured by the supply water temperature sensor 506, the control valve 303 operates to be opened, so that the relatively low-temperature water in the supply water path 407 before entering the heat recovery heat exchanger 205 can be preheated and increased in temperature.

The opening and closing of the control valve 303 can be controlled based on the cooling water outlet temperature $T_{C2}$ and the supply water supply temperature $T_{U1}$ to prevent that conversely, when the cooling water outlet temperature $T_{C2}$ is lower than the supply water supply temperature $T_{U1}$, the supply water supply temperature $T_{U1}$ is decreased and consequently, the temperature of the supply water after exiting from the heat recovery heat exchanger 205 is decreased.

Figure 2:
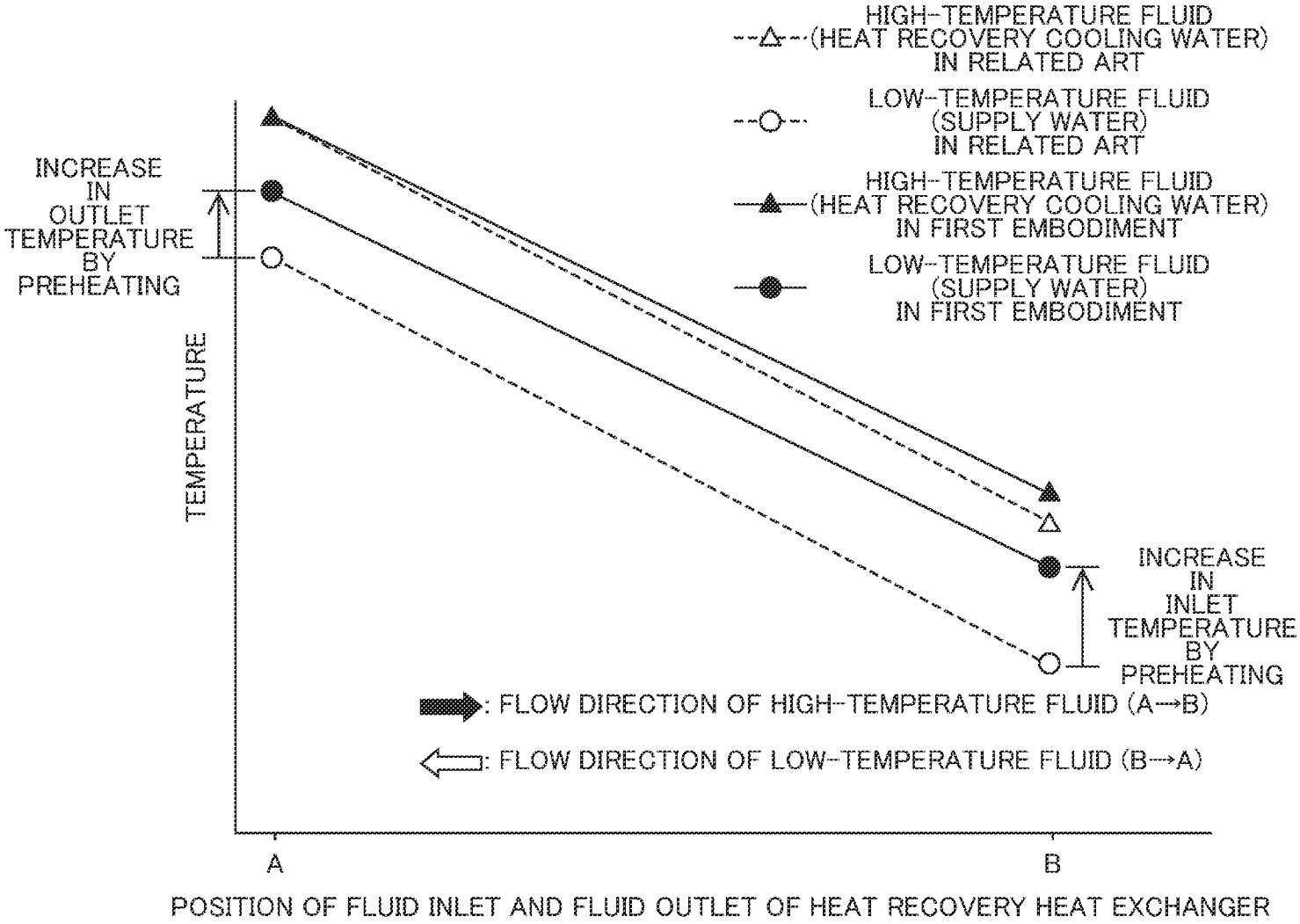
FIG. 2 is a graph illustrating effects obtained by the heat recovery system.

In FIG. 2, the supply water temperature at the outlet of the heat recovery heat exchanger 205 and the heat recovery cooling water temperature when the preheating of the water (supply water) in the supply water path 407 is not performed in the related art are compared with those when preheating is performed in the present invention. In this comparison, the type of the heat exchanger and the water flow rate are the same between the related art and the present invention.

When flow directions of a high-temperature fluid and a low-temperature fluid are defined as countercurrent flow directions in which the amount of exchanged heat can be increased, and the heat recovery cooling water that is the high-temperature fluid flows from an A end to a B end of the heat recovery heat exchanger 205, the supply water that is the low-temperature fluid flows from the B end to the A end of the heat recovery heat exchanger 205.

Regarding a temperature condition for the comparison, the temperature of the high-temperature fluid (heat recovery cooling water) at the A end of the heat recovery heat exchanger 205 is fixed to a condition of the related art and of the first embodiment, and the temperature of the low-temperature fluid (supply water) at the B end of the heat recovery heat exchanger 205 in the first embodiment is set to a temperature obtained by adding a preheating temperature amount of the supply water to a temperature in the related art. Incidentally, in the calculation of the heat exchanger, temperature differences between the high-temperature fluid and the low-temperature fluid on an A end side and on a B end side are set to be the same.

It can be seen that when the temperature of the low-temperature fluid (supply water) at the B end increases by the amount of preheating, the temperature of the low-temperature fluid (supply water) at the A end is higher than the temperature under the condition of the related art.

Accordingly, a facility at the hot water demand destination that uses the supply water can use hot water of a higher temperature compared to the case where preheating is not performed, and a wide range of applications where hot water can be used can be expected.

Incidentally, the first cooling water path 402 and the third cooling water path 405 do not necessarily need to form independent circuits. Even when a configuration is employed in which a cooling tower (not illustrated) that cools the cooling water is shared and the first cooling water path 402 and the third cooling water path branch from a common path from an outlet of the cooling tower to the heat recovery system of the present invention, the functions of the first embodiment are not affected.

In addition, the types of the heat exchangers are not limited to specific types, but regarding the preheating heat exchanger 207, since a temperature difference between the cooling water that is a high-temperature fluid and the supply water that is a low-temperature fluid is not so large, in order to increase the amount of exchanged heat, a plate type heat exchanger is more preferably used that has a relatively small external dimensions of the heat exchanger and is capable of increasing a heat transfer area.

As described above, the heat recovery system of the first embodiment is a heat recovery system including: the compressor 100 that compresses suctioned gas to discharge the compressed gas; the aftercooler 202 that cools the compressed gas; the oil cooler 203 that cools a lubricant; the first cooling water path 402 that supplies cooling water to the compressor 100 and the oil cooler 203; the second cooling water path 403 through which cooling water is circulated between the aftercooler 202 and the heat recovery heat exchanger 205 by the circulation pump 103; the supply water path 407 that exchanges heat with the high-temperature cooling water in the second cooling water path 403 via the heat recovery heat exchanger 205; the auxiliary cooling heat exchanger 206 that allows cooling water of the third cooling water path 405 to cool a temperature downstream from the outlet of the heat recovery heat exchanger 205 on the second cooling water path 403 to a temperature that does not interfere with operation of the compressor 100; and the auxiliary cooling bypass path 406 that allows the bypass of the cooling water to the auxiliary cooling heat exchanger 206.

The cooling water on an outlet side of the auxiliary cooling heat exchanger 206 on the third cooling water path 405 and the supply water that has passed through the preheating bypass path 409 branching from the location upstream from the inlet of the heat recovery heat exchanger 205 on the supply water path 407 exchange heat with each other via the preheating heat exchanger 207.

Further, when the measured value $T_{C2}$ of the temperature sensor 505 provided at an outlet of the auxiliary cooling heat exchanger 206 on the third cooling water path 405 is higher than the measured value $T_{U1}$ of the supply water temperature sensor 506 provided on the upstream side of the branch point of the preheating bypass path 409, the control valve 303 provided on the preheating bypass path 409 on the outlet side of the preheating heat exchanger 207 is opened.

According to the first embodiment, in the heat recovery system that recovers heat of compressed gas from the water-cooled gas compressor, the cooling water that is increased in temperature after cooling the heat recovery system and the relatively low-temperature supply water to be supplied for use as hot water exchange heat with each other via the heat exchanger to preheat the supply water, and then the supply water is reheated by the heat recovery heat exchanger of the heat recovery system, so that the supply water of a higher temperature can be supplied. Accordingly, a heat recovery rate of the heat recovery system can be improved by also recovering heat from a low-temperature heat source that normally only exhausts heat.

Second Embodiment

A configuration of a heat recovery system of a second embodiment will be described with reference to FIG. 3.

Figure 3:
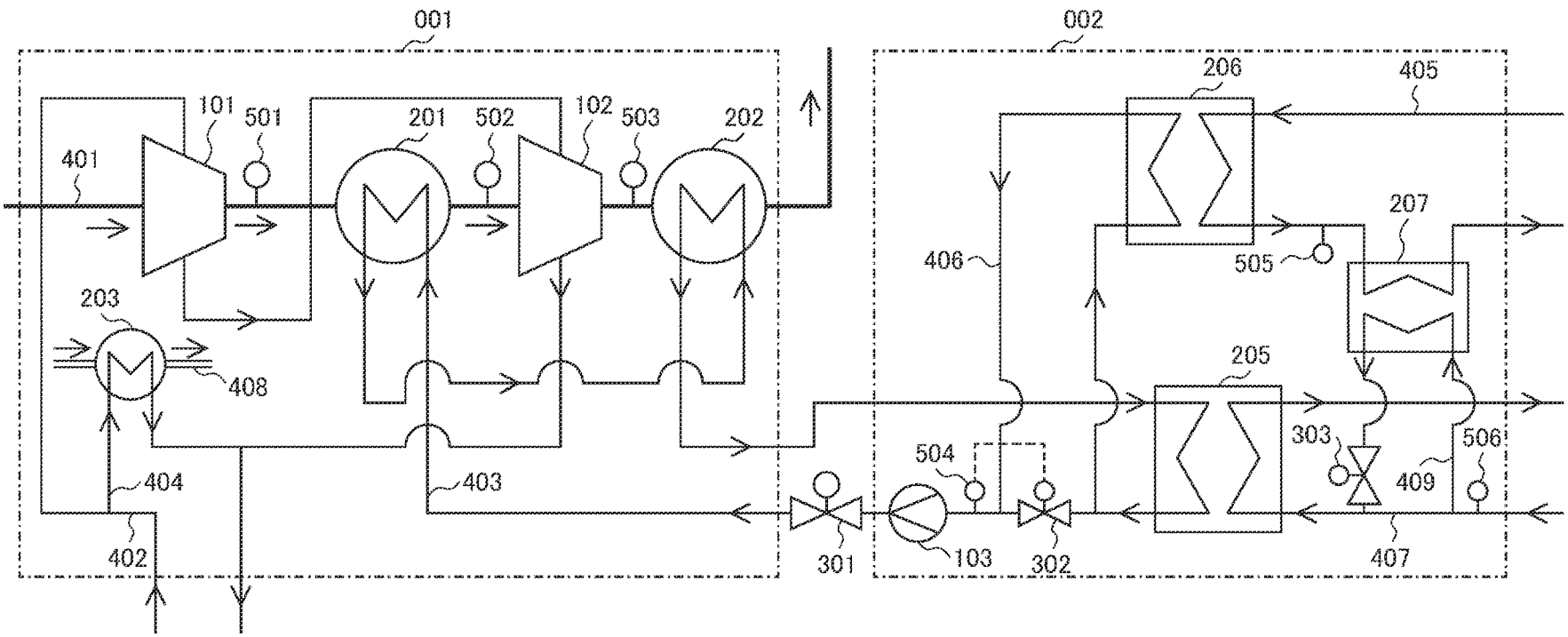
FIG. 3 is a system diagram illustrating a heat recovery system of a second embodiment.

FIG. 3 illustrates a system diagram of the heat recovery system. In FIG. 3, portions denoted by the same reference signs as those in FIG. 1 indicate the same or equivalent portions, and a description of the same portions as those in the first embodiment will be omitted.

The second embodiment illustrates a case where the compressor unit 001 of the first embodiment is configured as a two-stage oil-free air compressor including a low-pressure stage compressor 101, a high-pressure stage compressor 102, and an intercooler 201 that cools compressed air discharged from the low-pressure stage compressor 101. This configuration is suitable for a relatively large compressor unit that discharges a larger amount of compressed air than the single-stage compressor unit described in the first embodiments.

Regarding the compressor unit 001, the first cooling water path 402 branches to the oil cooler cooling path 404, and allows cooling water to flow to the compressor 101 and the compressor 102.

The second cooling water path 403 allows cooling water discharged from the circulation pump 103, to flow to the intercooler 201 and thereafter, to flow to the aftercooler 202. The configuration is such that the cooling water receives heat from the compressed air in two stages of the intercooler 201 and the aftercooler 202 to be sent to the heat recovery heat exchanger 205.

In the case of a method in which the cooling water of the second cooling water path 403 flows to the intercooler 201 and the aftercooler 202 in series to perform heat recovery, the temperature of hot water that is extracted can be more increased than in the water flowing method illustrated in the first embodiment, and the amount of recovered heat is increased. At this time, since the amount of heat increases that enters the high-temperature fluid side of the auxiliary cooling heat exchanger 206 via the auxiliary cooling bypass path 406, consequently, the amount of heat received by the cooling water on the third cooling water path 405 also increases. For this reason, a larger flow rate of the cooling water of the supply water path 407 can be preheated via the preheating heat exchanger 207 than in the case of the first embodiment.

As a flowing sequence of the cooling water of the second cooling water path 403, it is desirable that the cooling water flows to the intercooler 201 prior to flowing to the aftercooler 202. As a characteristic of the two-stage air compressor, the higher the cooling capacity of the intercooler 201 is, the more the compressed air is cooled and the smaller the volume is. For this reason, a pressure loss that is generated until the cooling water flows into the high-pressure stage compressor 102 can be suppressed to a small value, and the power consumption of the high-pressure stage compressor 102 can be reduced.

Since the cooling water initially flows to the intercooler 201, the compressed air in the low-pressure stage that passes through the intercooler 201 can be cooled by the low-temperature cooling water compared to when the cooling water initially flows to the aftercooler 202. For this reason, a decrease in the cooling performance of the intercooler 201 can be prevented, and an influence on the overall performance of the compressor unit 001 can be suppressed to a minimum.

Third Embodiment

A configuration of a heat recovery system of a third embodiment will be described with reference to FIG. 4.

Figure 4:
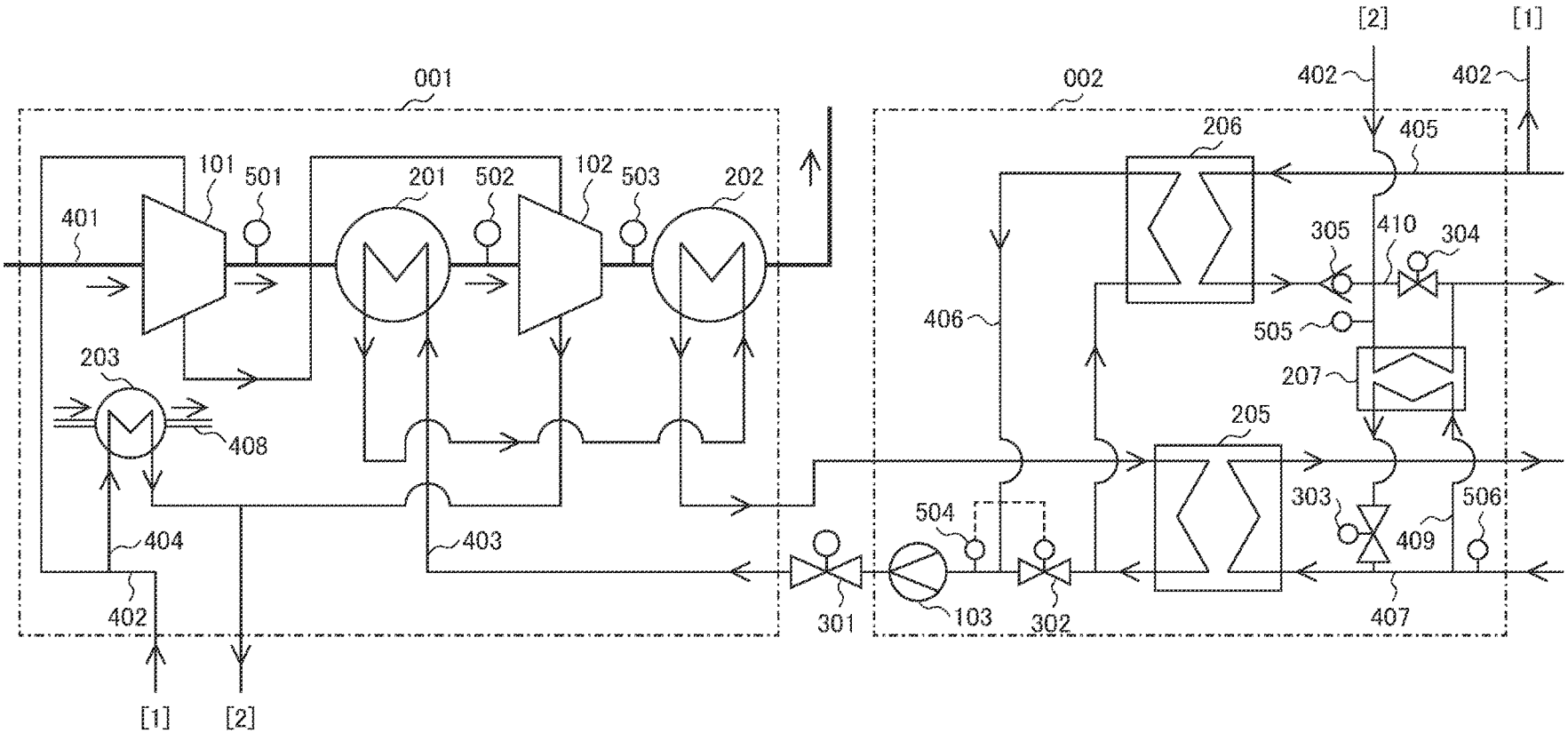
FIG. 4 is a system diagram illustrating a heat recovery system of a third embodiment.

FIG. 4 illustrates a system diagram of the heat recovery system. In FIG. 4, portions denoted by the same reference signs as those in FIGS. 1 and 3 indicate the same or equivalent portions, and a description of the same portions as those in the first and second embodiments will be omitted.

In the third embodiment, the third cooling water path 405 is configured to branch from the first cooling water path 402 at a location upstream from the heat recovery unit 002. Namely, low-temperature cooling water is supplied to the first cooling water path 402 and the third cooling water path 405 from a common cooling tower installed outside.

The third cooling water path 405 merges with the first cooling water path 402 after cooling devices inside the compressor unit 001, at a point downstream from the auxiliary cooling heat exchanger 206. A bypass path 410 branches from the same merge point to merge with the first cooling water path at a point downstream from an outlet on the high-temperature fluid side of the preheating heat exchanger 207.

A control valve 304 is installed on the bypass path 410. In addition, a check valve 305 is provided at the outlet of the auxiliary cooling heat exchanger 206 on the third cooling water path 405 to prevent the high-temperature cooling water of the first cooling water path 402 from flowing back to a third cooling water path 405 side.

The cooling water outlet temperature sensor 505 is installed between a merge point between the first cooling water path and the third cooling water path, and an inlet of the preheating heat exchanger 207, instead of being installed at the position described in the first and second embodiments.

When the cooling water outlet temperature $T_{C2}$ is higher than the supply water supply temperature $T_{U1}$, the control valve 303 is opened and the control valve 304 is closed to preheat supply water. When the cooling water outlet temperature $T_{C2}$ is lower than the supply water supply temperature $T_{U1}$, the control valve 303 is closed and the control valve 304 is opened not to preheat the supply water.

In addition, when the heat recovery cooling water temperature $T_{H2}$ measured by the heat recovery cooling water temperature sensor 504 is a heat recovery cooling water upper limit temperature $T_{HL}$ or more, control is performed such that the control valve 303 is closed and the control valve 304 is opened not to preheat the supply water.

In the third embodiment, since the cooling water of the first cooling water path cools the oil cooler 203, the low-pressure stage compressor 101, and the high-pressure stage compressor 102, a larger amount of heat can be recovered than the case of the single-stage compressor unit 001 illustrated in the first embodiment, and an increase in temperature by preheating can be further increased or a larger flow rate of the supply water can be preheated in combination with the amount of heat that the cooling water of the third cooling water path receives from the auxiliary cooling heat exchanger 206.

Further, in the first and second embodiments, the supply water can be preheated only while the temperature regulation valve 302 allows the bypass of the heat recovery cooling water to the auxiliary cooling heat exchanger 206. According to the third embodiment, even while the temperature regulation valve 302 does not allow the bypass of the cooling water, the high-temperature cooling water of the first cooling water path 402 is allowed to flow to the preheating heat exchanger 207, so that preheating can be more effectively performed.

On the other hand, when the temperature of the cooling water of the first cooling water path 402 after cooling the compressor unit 001 is abnormally high for any reason, the supply water is excessively preheated, and consequently, the heat recovery cooling water is insufficiently cooled by the heat recovery heat exchanger 205 and the auxiliary cooling heat exchanger 206. As a result, when the temperature of the heat recovery cooling water supplied to the compressor unit 001 is higher than the heat recovery cooling water upper limit temperature $T_{HL}$, there is a possibility that the cooling performance of the intercooler 201 is decreased and a defect occurs in the compressor unit 001.

In order to prevent this possibility, when the heat recovery cooling water temperature $T_{H2}$ is the heat recovery cooling water upper limit temperature $T_{HL}$ or more, control is performed such that the control valve 303 is closed and the control valve 304 is opened not to preheat the supply water. In order to prevent hunting of the valve or the like, in consideration of a margin, the heat recovery cooling water upper limit temperature $T_{HL}$ is set to a temperature slightly higher than the heat recovery cooling water control temperature $T_{HC}$ that is a temperature where the temperature regulation valve is fully closed.

In the first to third embodiments, the control valve 303 may be configured as a three-way vale capable of switching between water flowing and water stopping between one common direction and either of the remaining two directions among fluid paths in three directions, and when the control valve 303 is installed at a merge point between the supply water path 407 and the preheating bypass path 409 on the outlet side of the preheating heat exchanger 207 to preheat the supply water, the control valve 303 may be configured to be controlled such that a total amount of the supply water that flows through the supply water path 407 flows to the preheating heat exchanger 207 and the supply water is preheated and reheated by the heat recovery heat exchanger 205. With this configuration, a total amount of the supply water can be preheated by the preheating heat exchanger 207, and an improvement in heat recovery efficiency can be expected. On the other hand, when preheating is not performed, similarly, control is performed such that the control valve 303 is controlled to stop the flowing of the supply water to a preheating heat exchanger 207 side and to allow a total amount of the supply water to flow to the heat recovery heat exchanger 205.

Incidentally, the present invention is not limited to the above-described embodiments, and includes various modification examples. For example, in the embodiments, the example has been described in which the present invention is applied to the oil-free screw compressor; however, the present invention is not limited thereto, can also be applied to oil-cooled screw compressors or water-injection type screw compressors in the same manner, and can be applied to any fluid machine such as scroll compressors, roots blowers, and turbochargers in the same manner.

In addition, in the above-described embodiments, an example of the screw compressor including a pair of male and female screw rotors in a rotor chamber has been described; however, the present invention can also be applied to a single screw compressor including one screw rotor in the same manner. In addition, in the first to third embodiments, the example has illustrated in which water is used as the cooling water that circulates through the first cooling water path and through the second cooling water path 403; however, a case can be assumed in which a coolant liquid containing an antifreeze component such as alcohols, or oil is used, and the cooling water is not limited to only water. Further, a fluid that is supplied to the outside through the supply water path 407 after heat recovery is also not limited to water, and various fluids are assumed to be used as the fluid. The fluid is not limited to supply water, and a "supply liquid" may be considered as the fluid.

In addition, in the second and third embodiments, the intercooler 201 and the aftercooler 202 are connected to each other in series on the second cooling water path 403, but may be connected to each other in parallel. The flowing sequence of the cooling water on the first cooling water path 402 is a typical sequence, but is not limited thereto, and a sequence may be employed in which the cooling water initially flows to the high-pressure stage compressor 102 and then flows to the low-pressure stage compressor 101.

In the first to third embodiments, the preheating heat exchanger 207 is configured to be built in the heat recovery unit 002; but even when the preheating heat exchanger 207 is configured to be separately installed outside the heat recovery unit 002, the function is not affected.

In the first and second embodiments, the first cooling water path and the third cooling water path have been described as being independent of each other for convenience; but as in the third embodiment, even when the path is configured such that the outside cooling tower is shared and the third cooling water path branches from the first cooling water path outside the heat recovery system to merge again with each other, the functions of the present invention are not affected.

In addition, the above-described embodiments have been described in detail for easy understanding of the present invention, and the present invention is not necessarily limited to including all the described configurations.

REFERENCE SIGNS LIST

001 Compressor unit
002 Heat recovery unit
100 Compressor (single stage)
101 Low-pressure stage compressor
102 High-pressure stage compressor
103 Circulation pump
201 Intercooler
202 Aftercooler
203 Oil cooler
204 Cooling heat exchanger
205 Heat recovery heat exchanger
206 Auxiliary cooling heat exchanger
207 Preheating heat exchanger
301 Water supply valve
302 Temperature regulation valve
303 Control valve
304 Control valve

305 Check valve
401 Air path
402 First cooling water path
403 Second cooling water path
404 Oil cooler cooling path
405 Third cooling water path
406 Auxiliary cooling bypass path
407 Supply water path
408 Lubricant path
409 Preheating bypass path
410 Bypass path
501 Discharge air temperature sensor or low-pressure stage discharge air temperature sensor
502 High-pressure stage suction air temperature sensor
503 High-pressure stage discharge air temperature sensor
504 Heat recovery cooling water temperature sensor
505 Cooling water outlet temperature sensor
506 Supply water temperature sensor

The invention claimed is:

1. A heat recovery device connected to at least one compressor, the device comprising:
an auxiliary cooling heat exchanger that performs auxiliary cooling;
a heat recovery exchanger that heats supply water;
a preheating heat exchanger that preheats and supplies the supply water to the heat recovery exchanger;
a supply water path that supplies the supply water to the heat recovery exchanger; and
a preheating bypass path which branches from the supply water path to supply the supply water to the preheating heat exchanger, and through which the supply water preheated by the preheating heat exchanger returns to the supply water path,
wherein the preheating heat exchanger allows heat exchange between cooling water on an outlet side of the auxiliary cooling heat exchanger and the supply water that has passed through the preheating bypass path.

2. The heat recovery device according to claim 1,
wherein the heat recovery exchanger reheats the supply water that is preheated by the preheating heat exchanger and that returns to the supply water path through the preheating bypass path.

3. The heat recovery device according to claim 1, further comprising:
a first temperature sensor provided on the outlet side of the auxiliary cooling heat exchanger;
a second temperature sensor provided at a predetermined position on the supply water path; and
a control valve provided on an outlet side of the preheating heat exchanger on the preheating bypass path,
wherein when a detection temperature of the first temperature sensor is higher than a detection temperature of the second temperature sensor, the control valve performs control such that the control valve is opened to allow the preheating heat exchanger to preheat the supply water.

4. The heat recovery device according to claim 3,
wherein the predetermined position where the second temperature sensor is provided is a position on an upstream side of a branch point where the preheating bypass path branches from the supply water path.

5. The heat recovery device according to claim 3, further comprising:
a third temperature sensor provided on an outlet side of the heat recovery heat exchanger,
wherein when a detection temperature of the third temperature sensor is a predetermined threshold value or more, control is performed such that the control valve is closed to prevent the preheating heat exchanger from preheating the supply water.

6. The heat recovery device according to claim 3,
wherein the control valve is configured as a three-way valve including fluid entry ways in three directions, and
when the preheating heat exchanger preheats the supply water, the control valve is controlled to allow a total amount of the supply water to flow to the preheating heat exchanger.

7. The heat recovery device according to claim 1,
wherein the heat recovery device is connected to a plurality of the compressors.

8. A heat recovery device connected to at least one compressor, the device comprising:
an auxiliary cooling heat exchanger that performs auxiliary cooling;
a heat recovery exchanger that heats supply water;
a preheating heat exchanger that preheats and supplies the supply water to the heat recovery exchanger;
a supply water path that supplies the supply water to the heat recovery exchanger; and
a preheating bypass path which branches from the supply water path to supply the supply water to the preheating heat exchanger, and through which the supply water preheated by the preheating heat exchanger returns to the supply water path,
wherein the preheating heat exchanger allows heat exchange between cooling water supplied from an outside through a cooling water path and the supply water that has passed through the preheating bypass path.

9. The heat recovery device according to claim 8,
wherein the heat recovery exchanger reheats the supply water that is preheated by the preheating heat exchanger and that returns to the supply water path through the preheating bypass path.

10. The heat recovery device according to claim 8, further comprising:
a first temperature sensor provided on an inlet side of the preheating heat exchanger;
a second temperature sensor provided at a predetermined position on the supply water path;
a first control valve provided on an outlet side of the preheating heat exchanger on the preheating bypass path; and
a second control valve provided on a cooling water bypass path branching from the cooling water path,
wherein when a detection temperature of the first temperature sensor is higher than a detection temperature of the second temperature sensor, control is performed such that the first control valve is opened and the second control valve is closed to allow the preheating heat exchanger to preheat the supply water.

11. The heat recovery device according to claim 10,
wherein when a detection temperature of the first temperature sensor is lower than a detection temperature of the second temperature sensor, control is performed such that the first control valve is closed and the second control valve is opened to prevent the preheating heat exchanger from preheating the supply water.

12. The heat recovery device according to claim 10,
wherein the predetermined position where the second temperature sensor is provided is a position on an upstream side of a branch point where the preheating bypass path branches from the supply water path.

13. The heat recovery device according to claim 10, further comprising:

a third temperature sensor provided on an outlet side of the heat recovery heat exchanger, wherein when a detection temperature of the third temperature sensor is a predetermined threshold value or more, control is performed such that the first control valve is closed and the second control valve is opened to prevent the preheating heat exchanger from preheating the supply water.

14. The heat recovery device according to claim 8, further comprising:

a check valve provided on an outlet side of the auxiliary cooling heat exchanger to prevent a backflow of the cooling water passing through the cooling water path.

15. The heat recovery device according to claim 10, wherein the first control valve is configured as a three-way valve including fluid entry ways in three directions, and when the preheating heat exchanger preheats the supply water, the first control valve is controlled to allow a total amount of the supply water to flow to the preheating heat exchanger.

16. The heat recovery device according to claim 8, wherein the heat recovery device is connected to a plurality of the compressors.

* * * * *